United States Patent [19]

Shih

[11] Patent Number: 4,800,833

[45] Date of Patent: Jan. 31, 1989

[54] TUBULAR DOOR LOCK WITH A BELL

[76] Inventor: Nan C. Shih, 116, Chantsao Rd., Changhua City, Taiwan, 500

[21] Appl. No.: 923,739

[22] Filed: Oct. 28, 1986

[51] Int. Cl.[4] ..... G08B 13/08

[52] U.S. Cl. ..... 116/10; 116/97; 116/153

[58] Field of Search ..... 116/9, 10, 92, 96, 97, 116/153, 154, 155, 156, 164

[56] References Cited

U.S. PATENT DOCUMENTS

| | | | |
|---|---|---|---|
| 219,314 | 9/1879 | Silva | 116/10 |
| 356,606 | 1/1887 | Thomas et al. | 116/9 |
| 535,288 | 3/1895 | Holman | 116/10 |
| 691,064 | 1/1902 | Lippincott | 116/10 |
| 716,471 | 12/1902 | Pickop et al. | 116/156 |
| 818,362 | 4/1906 | Edey | 116/9 |
| 888,725 | 5/1908 | Moore | 116/156 |
| 983,626 | 2/1911 | Kriz | 116/10 |
| 1,030,841 | 6/1912 | Colounese et al. | 116/10 |
| 3,039,423 | 6/1962 | Warn | 116/155 |
| 4,577,584 | 3/1986 | Shih | 116/10 |

*Primary Examiner*—Steven L. Stephan
*Assistant Examiner*—Thomas B. Will
*Attorney, Agent, or Firm*—Holman & Stern

[57] ABSTRACT

A sort of tubular door lock whose inside knob or outside knob can be forced to rotate by each other's rotation and force a rotating unit to turn pushing and overpassing a projection of a knocking spring to get the knocking points at its both ends to knock on a bell for ringing. In addition, when said inside knob is locked up, the outside knob has no supporting force for making the latch rotated but can give an idle turning only.

2 Claims, 5 Drawing Sheets

TUBULAR DOOR LOCK WITH A BELL

BACKGROUND OF THE INVENTION

A door for preventing burglary is usually equipped with a lock and in addition with a door bell so that persons indoors may be warned that somebody is at the door. The inventor had once filed an application, "A BELL LOCK" with Ser. No. 683,360 for a patent in United States, but given it up later. The inventor filed, again in United States, an application of the same title with a different structure which was numbered with Ser. No. 685,491 and granted a patent numbered U.S. Pat. No. 4,577,584. But the structure of said U.S. Pat. No. 4,577,584, whose bell will not work if it is locked from the inside, can not totally function as a bell.

The purpose of this invention is to provide a tubular door lock whose outside knob can be turned around whether it is locked or not, and this lock can function as a bell completely, too.

SUMMARY OF THE INVENTION

This tubular door lock whose inside knob and outside knob are not combined to interact directly but indirectly. An assembling plate is set with a square shaft hole for matching with a square shaft of the outside knob and lunar slots for matching with a pipe shaft of said inside knob. Said pipe shaft is set with a rotating unit and a bell. The rotation of either of the knobs can start the rotating unit, and the protrusions of said rotating unit are then to push and overpass gradually a projection set at a knocking spring and make one of its ends raised up at first. When the pushing force disappears, said spring will automatically return back by its own elasticity knocking on the bell for ringing. When the locking structure of said inside knob is locked up, the flat plate in the square shaft of said outside knob can be turned around to make the steel balls of said square shaft move inwards so that the rotation of said square shaft do not activate the linking plate of the latch,enabling said inside or outside knob to rotate idly only.

DETAILED DESCRIPTION OF THE INVENTION

Figure 1:
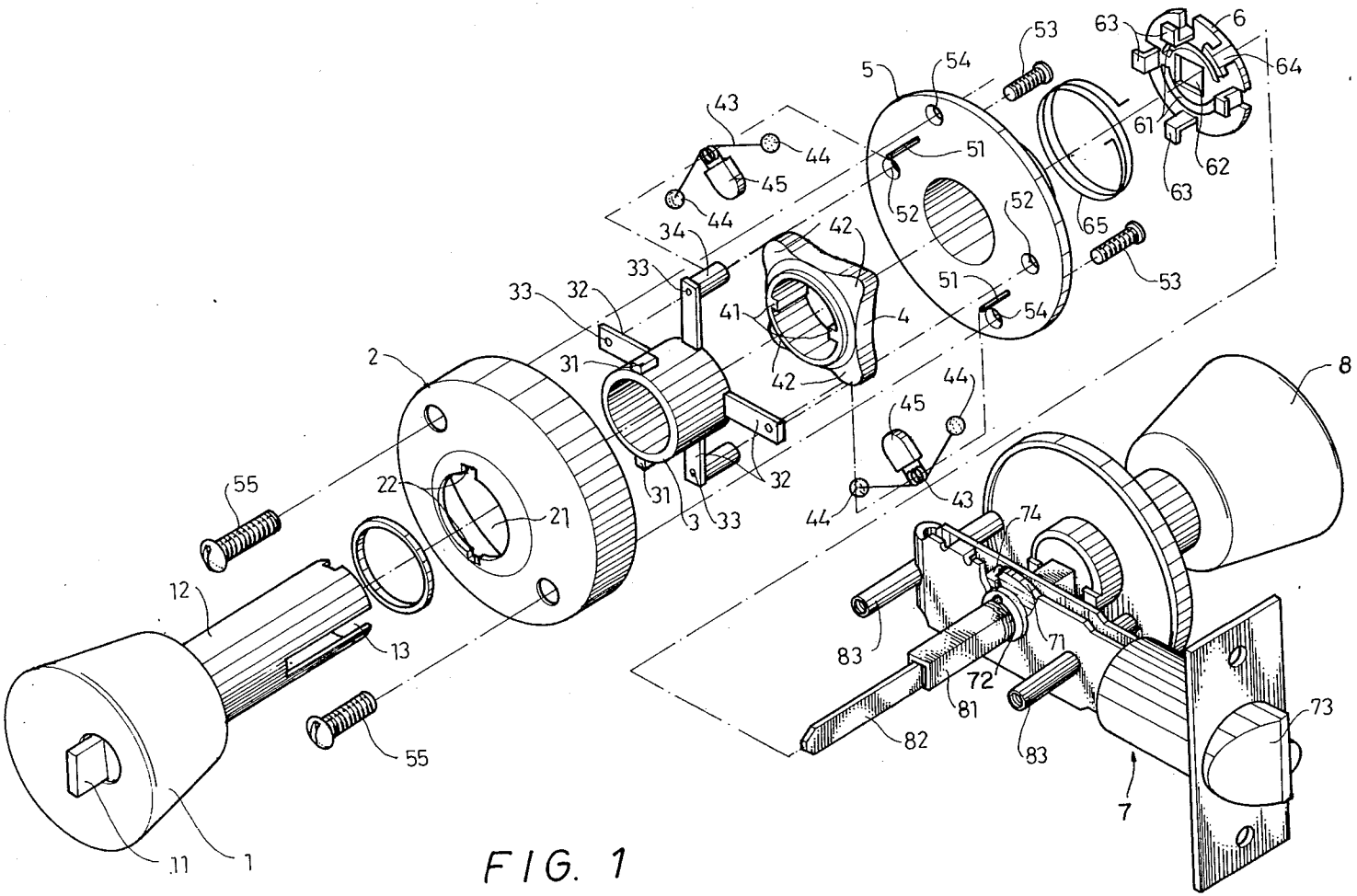
FIG. 1 is an exploded perspective view of the tubular door lock with a bell in this invention.

First, as shown in FIG. 1, this tubular door lock unit with a bell comprises inside knob 1, bell 2, fixing frame 3, rotating plate 4, fixing plate 5, assembling plate 6, latch 7 and outside knob 8.

Inside knob 1 is the same as that used in conventional door locks and, by the rotation of its locking structure 11, can force a flat plate 82 of the outside knob 8 to move. Pipe shaft 12 included in the inside knob 1 is used for assembling with bell 2, fixing frame 3, rotating plate 4, fixing plate 5 and assembling plate 6 in order and possesses two straight slots 13 for projections 41 of the rotating unit to fit in so that the rotating unit 4 can be forced to turn and outside knob 8 accordingly forced to turn as well when inside knob 1 is turned around.

Bell 2 used for ringing has hole 21 and two notches at its center. Hole 21 is to be inserted by pipe shaft 12 and notches 22 to receive projections 31 of fixing frame 3.

Fixing frame 3 has four feet 32 extending out latitudinally; two of them are provided at their ends with pipes 34 respectively and fixed on the fixing plate 5 with a screw 53 respectively, and the other two are respectively bored with hole 33 for pin 51 of fixing plate 5 to penetrate through. Projections 31 of fixing frame 3 is able to keep the bell in a certain position.

Rotating unit 4 is assembled between fixing frame 3 and fixing plate 5, and has two inner projections 41 locked in slots 13 of inside knob 1 and four protrusions 42 symmetrically set on its outside surface.

Pins 51 of fixing plate 5 are assembled with knocking springs 43 which are able to rise up or fall down with pin 51 acting as an axia and have respectively at their two sides knocking point 44, at its middle is projection 45 which is to be pushed by protrusions 42 of rotating unit when it is rotating.

Fixing plate 5 has two pins 51 respectively to combine with knocking springs 43, two holes 52 fo screws 53 to combine together with fixing frame 3 and two holes 54 for screws 55 to penetrate through for screwing hollow rods 83 of outside knob 8.

Assembling plate 6 comprises two lunar slots 61 to match with pipe shaft 12 of inside knob 1, square opening 62 at its center to receive square shaft 81 of outside knob 8 so that the rotation either of inside or outside knob can force assembling plate to rotate, and four hooks 63 which are each hung with spring 65 that has one of its ends connected with ear 64 of assembling plate 6 and the other end hooked at fixing plate 5; spring 65 is to automatically pull the inside or outside knob back to their normal position after being rotated.

Latch 7 is almost the same as that used in conventional door locks with an exception that shaft hole 72 of linking plate 71 is shaped as a flower petal. The structure of outside knob 8 is the same as that used in conventional door locks, having square shaft 81, flat plate 82 and hollow rods 83, etc.

Figure 2:
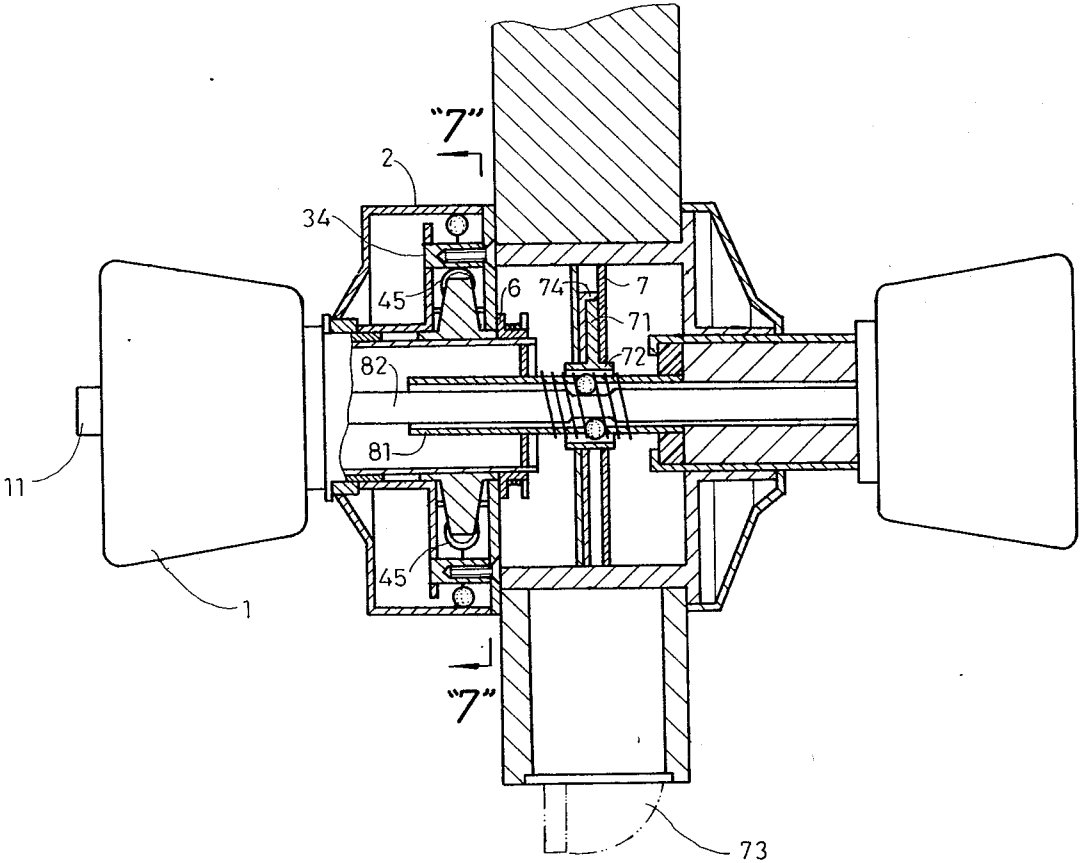
FIG. 2 is a cross-sectional view of this door lock wholly assembled in this invention.

Next, FIG. 2 shows a cross-sectional view of this invention after having all the main parts assembled together. Bell 2 and inside knob 1 are set at the interior side of the door; bell 2 covers inside a plurality of parts; the interaction between said inside and outside knobs is dependent on assembling plate 6; in addition, square shaft 81 penetrate through shaft hole 72 in linking plate 71 and has flat plate 82 inside, which extends out from outside knob 8 to locking structure 11 of inside knob 1.

As for the mutual linking relations between inside knob 1, outside knob 8, square shaft 81 and flat plate 82, they are so simple as well known that they are omitted here.

Again as shown in FIG. 1, when latch bolt 73 of latch 7 is expected to move inwards, it is necessary to turn inside knob 1 or outside knob 8 so as to move square shaft 81, and then to force linking plate 71 that next push hook 74 in order to pull latch bolt 73 inwards.

The relative motion of square shaft 81 and linking plate 71 is a very important idea and design in this invention.

Figure 4:
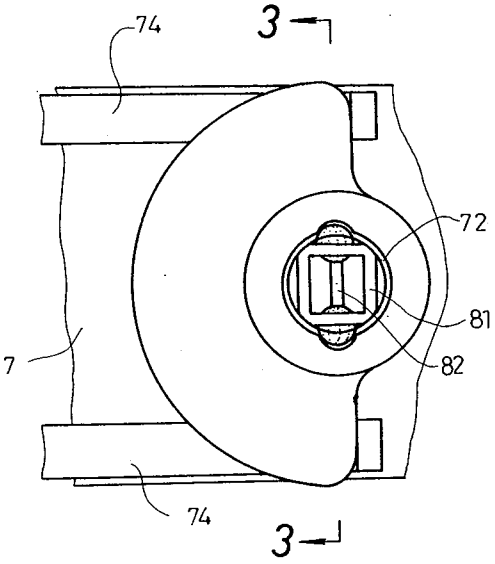
FIG. 4 is a view of fitting condition of the square shaft with the linking plate in case of the flat plate unlocked in this invention.
Figure 3:
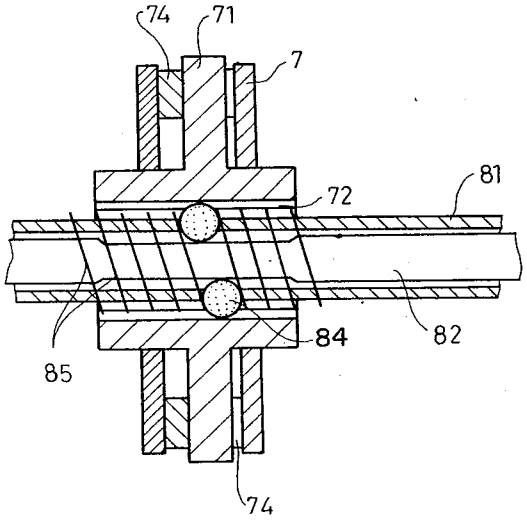
FIG. 3 is a cross-sectioned view of 3—3 on line FIG. 4.

FIGS. 3, 4 show that shaft hole 72 is not square but shaped like a flower petal. Square shaft 81 can not directly force linking plate 71 to rotate but needs a help of at least a couple of steel balls 84, which can protrude outside square shaft 81 to lock in shaft hole 72 and are pushed by springs 85 preventing it from moving off; and besides, the steel balls must be pushed by flat plate 82 so that part of the balls are stuck outside of spring 85 becoming unable to move back. Otherwise linking plate 71 cannot turn.

FIGS. 3, 4 also show that locking structure 11 is not in the state of locked up but in the situation that flat plate 82 is vertically positioned pushing steel balls 84 into petal-shaped shaft holes 72. Under this condition, when inside knob 1 or outside knob 8 is turned around, square shaft 81 ban be turned to force the movement of locking plate 71 and hook 74 in order, and finally move latch bolt 73 inwards.

Figure 6:
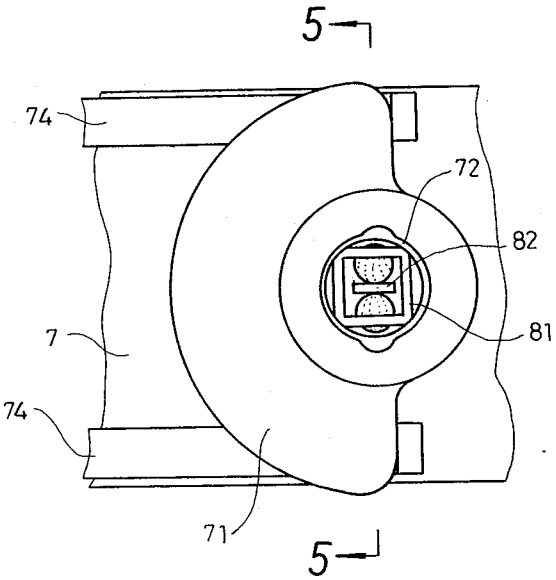
FIG. 6 is a view of fitting condition of the square shaft with the linking plate in case of the flat plate locked in this invention.
Figure 5:
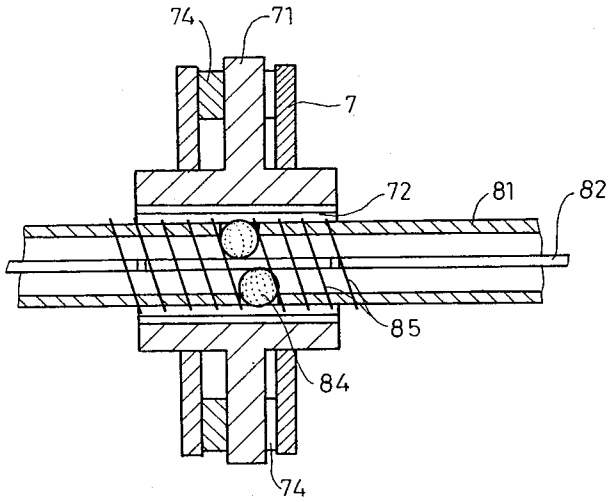
FIG. 5 is a cross-sectioned view of 5—5 on line FIG. 6.

But, on the contrary, FIGS. 5, 6 show that locking structure 11 is turned around for 90° to become locked up. Under this situation, flat plate 82 is positioned horizontally so that steel balls 84 are not pushed any more but drop in square shaft 81. So, when inside knob 1 or outside knob 8 is turned around, square shaft 81 turns at the same time, but does not force linking plate 71 to turn; at this moment, as there is no transmitting force existing between shaft hole 72 and square shaft 81, latch bolt 73 cannot be moved inwards.

Figure 9:
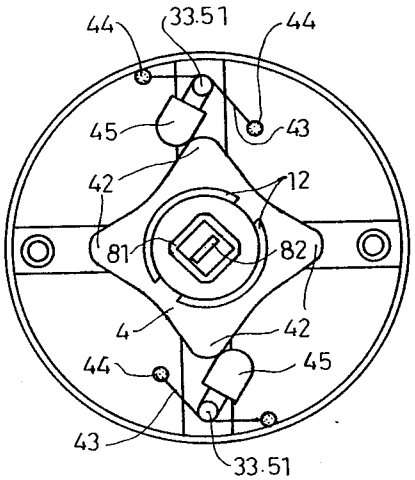
FIG. 9 is a cross-sectioned view of the rotating unit automatically returned to its normal position when the turned knob has been released under the condition of FIG. 8.
Figure 8:
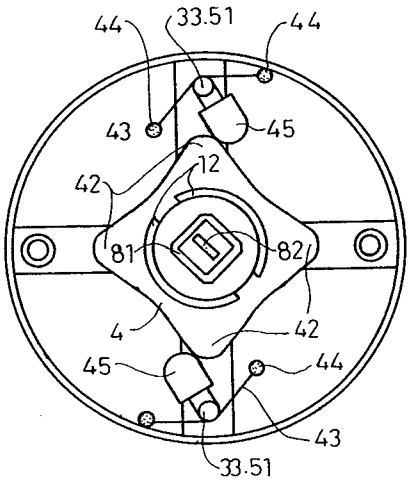
FIG. 8 is an action view when the knob is turned under the condition of FIG. 7.
Figure 7:
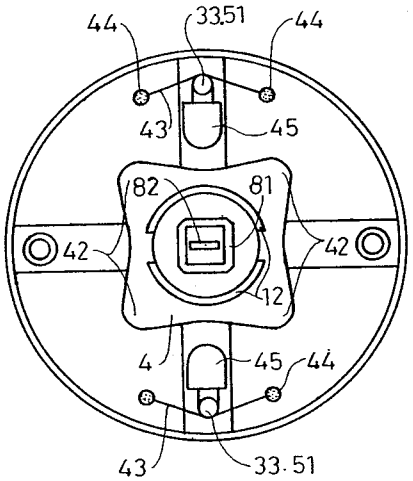
FIG. 7 is a cross-sectioned view of 7—7 on line FIG. 2.

FIG. 7 is a cross-sectional view of 7—7 on line FIG. 2. Springs 43 are supported by pins 51 so that two knocking points 44 can knock on the interior surface of bell 2. In addition, in spite of the situations shown in FIGS. 3, 4, 5 or 6, when inside knob 1 or outside knob 8 is turned, protrusions 42 of rotating unit 4 squeeze projection 45 and at this moment one end of knocking spring 43 is raised up gradually until protrusion 42 overpasses projection 45, and then spring 43 quickly moves back to its original position, which makes knocking point 44 knock on bell 2 to make a sound of ringing. Usually, one round of turning inside knob 1 or outside knob 8 causes rotating unit 4 to turn for 85°. Therefore, two protrusions 42, can give two knocks per one round of turning, and other two knocks when rotating unit 4 automatically returns to its original position as shown in FIG. 9. So persons indoor can be warned that somebody is opening the door by short clinking sounds of ringing.

Even locking structure 11 of inside knob 1 is locked up, outside knob 8 can still be turned around to ring bell 2 so that it can be used as a door bell. Nevertheless, it is impossible for a burglar to move latch bolt 7 inward illegally.

What is claimed is:

1. A tubular door lock with a bell comprising, an inside knob constructed with a locking structure and a pipe shaft cut with two straight slots, a bell bored with a hole which is penetrated by said pipe shaft and which has two notches in which respective projections of a fixing frame fit, said fixing frame containing four radiating arms, two of said arms having axial projections connected to a fixing plate, the other two of said arms each being bored with a hole, and the fixing frame further having two projections located in the notches of said bell, said fixing plate containing a hole for a screw to penetrate to link said bell to an outside knob, and two pins, the pins being inserted in the respective holes in said fixing frame, two sticker springs, each pivotally carried on a respective one of the pins for striking internally against the bell, each striker spring having a central pivot, a contact head adjacent the pivot, a pair of spring arms extending outwardly from the pivot, and a striker at the end of each arm, a rotating unit having a protruded circle at each of its two sides for matching with said fixing frame and said fixing plate, and four protrusions able to squeeze and overpass the contact heads of the striker springs, an assembling plate having two lunar slots for assembling with said inside knob, a square opening for assembling with a square shaft of said outside knob, four hooks for further spring respectively to hook around and an ear for connecting with one end of said further spring, said further spring having one end connected with said ear and the other end fixed at said fixing plate, so that said fixing plate can automatically return to its original position after either of the knobs is turned around, said square shaft being connected with a linking plate to rotate the linking plate, a latch to be pulled or released by the linking plate and which has a shaft hole to be penetrated by said square shaft of said outside knob to rotate and to move a latch bolt, and characteristics that the rotation of said outside knob will be transmitted to move said rotating unit causing said protrusions sequentially to press against the contact heads of the respective striker springs, with pressure of a respective protrusion against a respective contact head effecting pivotal movement of a respective striker spring on its respective pivot until one of the strikers engages the interior of the bell where upon subsequent release of the contact head on passage of the protrusion causes the striker to strike against the interior of the bell due to the resilience of the respective spring arm.

2. A door lock as claimed in claim 1 wherein the protrusions on the rotating unit engage and release respective contact heads during rotation of the unit in both forward and reverse directions to operate the bell with one arm and striker of each striker spring during forward rotation and with the other arm and striker of each striker spring during reverse rotation.

* * * * *